US008141985B2

(12) United States Patent
Miyata

(10) Patent No.: US 8,141,985 B2
(45) Date of Patent: Mar. 27, 2012

(54) LIQUID EJECTING HEAD, LIQUID EJECTING APPARATUS, AND METHOD FOR MANUFACTURING LIQUID EJECTING HEAD

(75) Inventor: Yoshinao Miyata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 298 days.

(21) Appl. No.: 12/624,323

(22) Filed: Nov. 23, 2009

(65) Prior Publication Data

US 2010/0134564 A1 Jun. 3, 2010

(30) Foreign Application Priority Data

Nov. 28, 2008 (JP) ..... 2008-303744

(51) Int. Cl.
*B41J 2/14* (2006.01)
*B41J 2/16* (2006.01)

(52) U.S. Cl. ..... 347/50; 347/58

(58) Field of Classification Search ..... 347/50, 347/58, 59, 85, 86
See application file for complete search history.

(56) References Cited

U.S. PATENT DOCUMENTS 6,619,785 B1 * 9/2003 Sato ..... 347/50
6,802,597 B2 10/2004 Furuhata
7,349,204 B2 3/2008 Tanaka et al.

FOREIGN PATENT DOCUMENTS

JP 2000-323895 A 11/2000
JP 2003-159800 A 6/2003
JP 2004-148813 A 5/2004
JP 2005-254616 A 9/2005
JP 2006-235696 A 9/2006

* cited by examiner

*Primary Examiner* — Thinh Nguyen
(74) *Attorney, Agent, or Firm* — Kilpatrick Townsend & Stockton LLP

(57) ABSTRACT

A liquid ejecting head is provided which ejects liquid from nozzle openings by driving pressure generating elements, and includes: at least two rows of lead electrodes that supply an electrical signal to the pressure generating elements; and at least two wiring boards for supplying the electrical signal to the lead electrodes, wherein: the wiring boards respectively have individual wires which are electrically connected to the pressure generating elements, respectively, via the lead electrodes, and common wires which are electrically connected in common to a plurality of pressure generating elements via the lead electrodes; and, the wiring boards are formed such that a spacing between the respective common wires of the two opposing wiring boards is narrower than a spacing between the respective individual wires of the two opposing wiring boards.

8 Claims, 6 Drawing Sheets

LIQUID EJECTING HEAD, LIQUID EJECTING APPARATUS, AND METHOD FOR MANUFACTURING LIQUID EJECTING HEAD

This application claims priority to Japanese Patent Application No. 2008-303744, filed Nov. 28, 2008 the entirety of which is incorporated by reference herein.

BACKGROUND

1. Technical Field

The present invention relates to a liquid ejecting head that ejects liquid from nozzle openings, a liquid ejecting apparatus having such a liquid ejecting head, and a method for manufacturing such a liquid ejecting head. More particularly, the present invention relates to an ink jet recording head that ejects ink as liquid, an ink jet recording apparatus having such an ink jet recording head, and a method for manufacturing such an ink jet recording head.

2. Related Art

As a typical example of a liquid ejecting head that ejects liquid droplets, there is known an ink jet recording head that ejects ink droplets. For example, a known ink jet recording head includes a flow path forming substrate which has formed therein pressure generating chambers communicated with nozzle openings and communicating portions communicated with the pressure generating chambers, piezoelectric elements which are formed on one surface side of the flow path forming substrate, and a protective substrate which is bonded to the surface of the flow path forming substrate where the piezoelectric elements are formed and which has formed therein a piezoelectric element holding portion for holding the piezoelectric elements. On the protective substrate, an IC is mounted which is a driving circuit for driving the piezoelectric elements. The driving circuit and the piezoelectric elements are connected by a wire bonding method using connection wires, which are configured by conductive wires, via lead electrodes which are led out from electrodes on one side of the piezoelectric elements.

Some protective substrates are configured to protect two rows of piezoelectric elements which are arranged so as to correspond to two rows of opposing pressure generating chambers. In this kind of protective substrate, a through-hole is formed at the central portion thereof so that the connection wires are inserted thereto. In such an ink jet recording head, the lead electrodes and the connection wires are connected at the through-hole portion (for example, see JP-A-2004-148813).

However, in the above-described technique, since the driving circuit and the piezoelectric elements are connected by the wire bonding method, the manufacturing cost will increase and it becomes difficult to achieve a high-density mounting. Moreover, since the driving circuit is planarly arranged on the protective substrate, the size of an actuator portion including the piezoelectric elements will increase, which results in an increase in the manufacturing cost.

Such problems are similarly found in other liquid ejecting heads ejecting droplets of different liquid other than ink as well as the ink jet recording head ejecting ink droplets.

SUMMARY

An advantage of some aspects of the invention is to provide a liquid ejecting head capable of achieving a reduction in manufacturing cost and easily realizing a high-density mounting, a liquid ejecting apparatus having such a liquid ejecting head, and a method for manufacturing such a liquid ejecting head.

According to an aspect of the invention, there is provided a liquid ejecting head which ejects liquid from nozzle openings by driving pressure generating elements, including at least two rows of lead electrodes that supply an electrical signal to the pressure generating elements; and at least two wiring boards for supplying the electrical signal to the lead electrodes, wherein: the wiring boards respectively have individual wires which are electrically connected to the pressure generating elements, respectively, via the lead electrodes, and common wires which are electrically connected in common to a plurality of pressure generating elements via the lead electrodes; and, the wiring boards are formed such that a spacing between the respective common wires of the two opposing wiring boards is narrower than a spacing between the respective individual wires of the two opposing wiring boards.

According to this aspect of the invention, since the wiring boards and the lead electrodes of the piezoelectric elements can be connected without using bonding wires, it is possible to achieve a reduction in manufacturing cost easily.

Moreover, since the two wiring boards are formed such that the spacing between the opposing common wires is narrower than the spacing between the opposing individual wires, the alignment at the time of connecting the respective wiring boards to the lead electrodes can be achieved by using the opposing common wires. As a result, the alignment can be performed with high accuracy owing to the narrow spacing between the common electrodes. On the other hand, since the spacing between the opposing individual wires at the time of connecting the respective wiring boards to the lead electrodes is widened, it is possible to securely prevent occurrence of short-circuits between the mutual individual wires, thereby achieving a reliable connection. That is to say, it is possible simultaneously to meet two trade-off requirements that the extreme ends of the opposing wiring boards should preferably be at as close a distance as possible during the alignment, whereas the extreme ends of the opposing wiring boards should preferably be at as far a distance as possible from the viewpoint of preventing occurrence of short-circuits between the mutual individual wires. Therefore, it is possible not only to achieve high accuracy in the alignment but also securely to prevent the occurrence of short-circuits.

It may be preferable that the respective wiring boards are formed to be erected from a surface having the lead electrodes provided thereon. By doing so, a further increase in integration density can be achieved.

It may be preferable that the respective wiring boards are supported by a support member that supports the wiring boards to be erected from the surface having the lead electrodes provided thereon. By doing so, the wiring boards can be maintained at a stably supported state.

It may be preferable that a driving circuit that applies a driving voltage to the pressure generating elements is mounted on each of the wiring boards at a region facing the support member. In this case, since heat generated by the driving circuit can be dissipated through the support member, a stable operation of the driving circuit can be guaranteed.

It may be preferable that a connection of the wiring boards to the lead electrodes is achieved via an anisotropic conductive material. According to this configuration, by only downwardly pressing the anisotropic conductive material to be collapsed, it is possible to achieve a desired electrical connection easily.

According to another aspect of the invention, there is provided a liquid ejecting apparatus including the liquid ejecting head according to the aspect.

According to this aspect of the invention, the liquid ejecting apparatus can exhibit the same operation and effect as those of the liquid ejecting head.

According to a further aspect of the invention, there is provided a method for manufacturing a liquid ejecting head which ejects liquid from nozzle openings by driving pressure generating elements and includes: at least two rows of lead electrodes that supply an electrical signal to the pressure generating elements; and first and second wiring boards respectively having individual wires which are electrically connected to the pressure generating elements, respectively, via the lead electrodes, and common wires which are electrically connected in common to a plurality of pressure generating elements via the lead electrodes, the method including the steps of: arranging the first and second wiring boards so as to oppose each other such that a spacing between the common wires of the first wiring board and the common wires of the second wiring board is smaller than a spacing between the individual wires of the first wiring board and the individual wires of the second wiring board; adjusting a relative position of the first wiring board and the second wiring board using the common wires after the first and second wiring boards are arranged so as to oppose each other; and connecting the first and second wiring boards having adjusted their relative position to the respective lead electrodes.

According to this aspect of the invention, since the alignment at the time of connecting the respective wiring boards to the lead electrodes can be achieved by using the opposing common wires, the alignment can be performed with high accuracy owing to the narrow spacing between the common electrodes. On the other hand, since the spacing between the opposing individual wires at the time of connecting the respective wiring boards to the lead electrodes is widened, it is possible to securely prevent occurrence of short-circuits between the mutual individual wires, thereby providing a reliable connection.

It may be preferable that the adjusting step adjusts the positions of the common electrodes of the second wiring board to be aligned with the positions of the common electrodes of the first wiring board in a state where the first wiring board is supported on one surface of a support member, whereby the second wiring board is supported on the other surface of the support member. In this case, the wiring boards can be maintained at a stably supported state.

BRIEF DESCRIPTION OF THE DRAWINGS

The invention will be described with reference to the accompanying drawings, wherein like numbers reference like elements.

DESCRIPTION OF EXEMPLARY EMBODIMENT

An exemplary embodiment will be described herein below with reference to the accompanying drawings.

Figure 1:
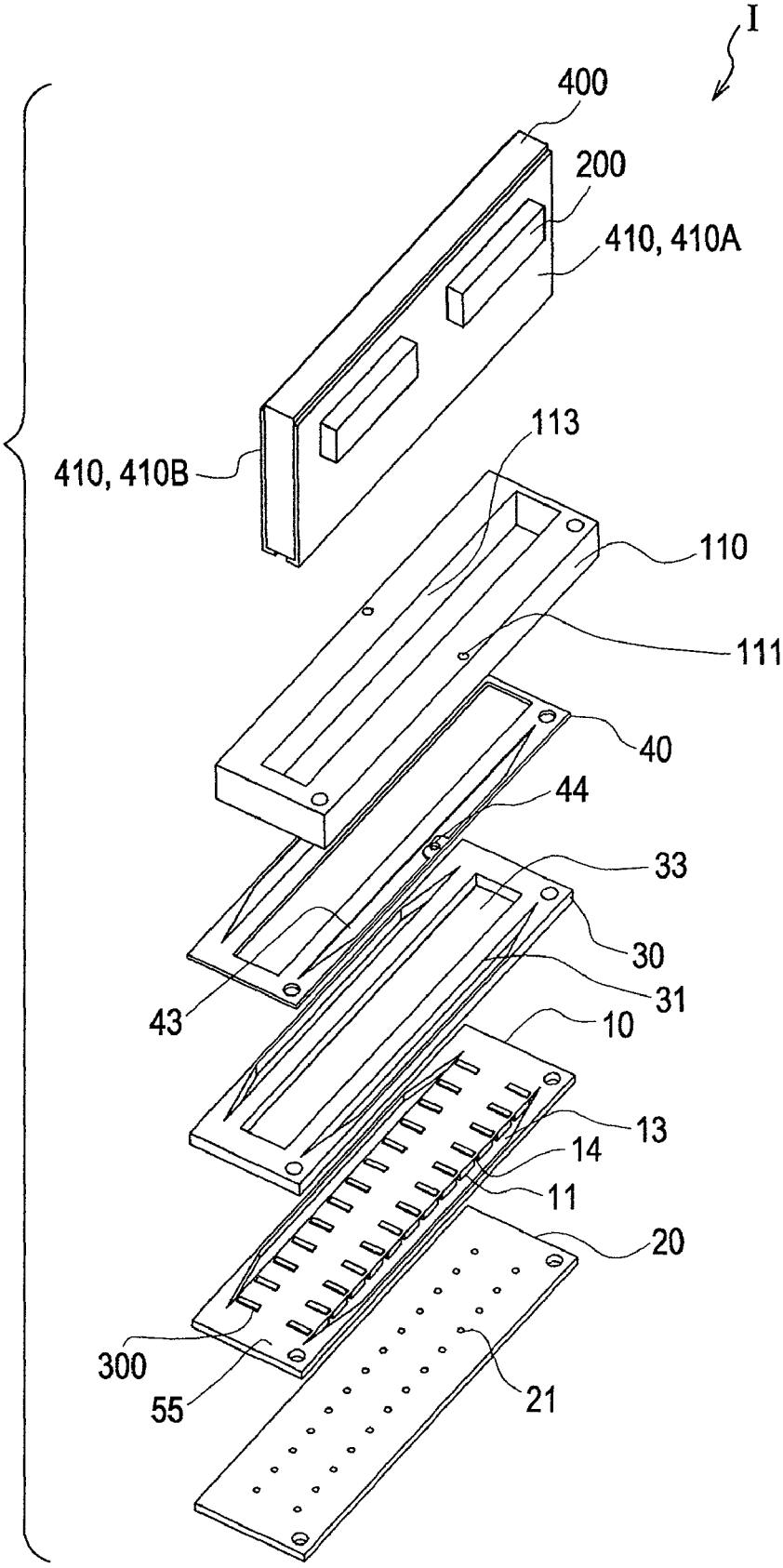
FIG. 1 is an exploded perspective view of a recording head according to an embodiment of the invention.
Figure 2:
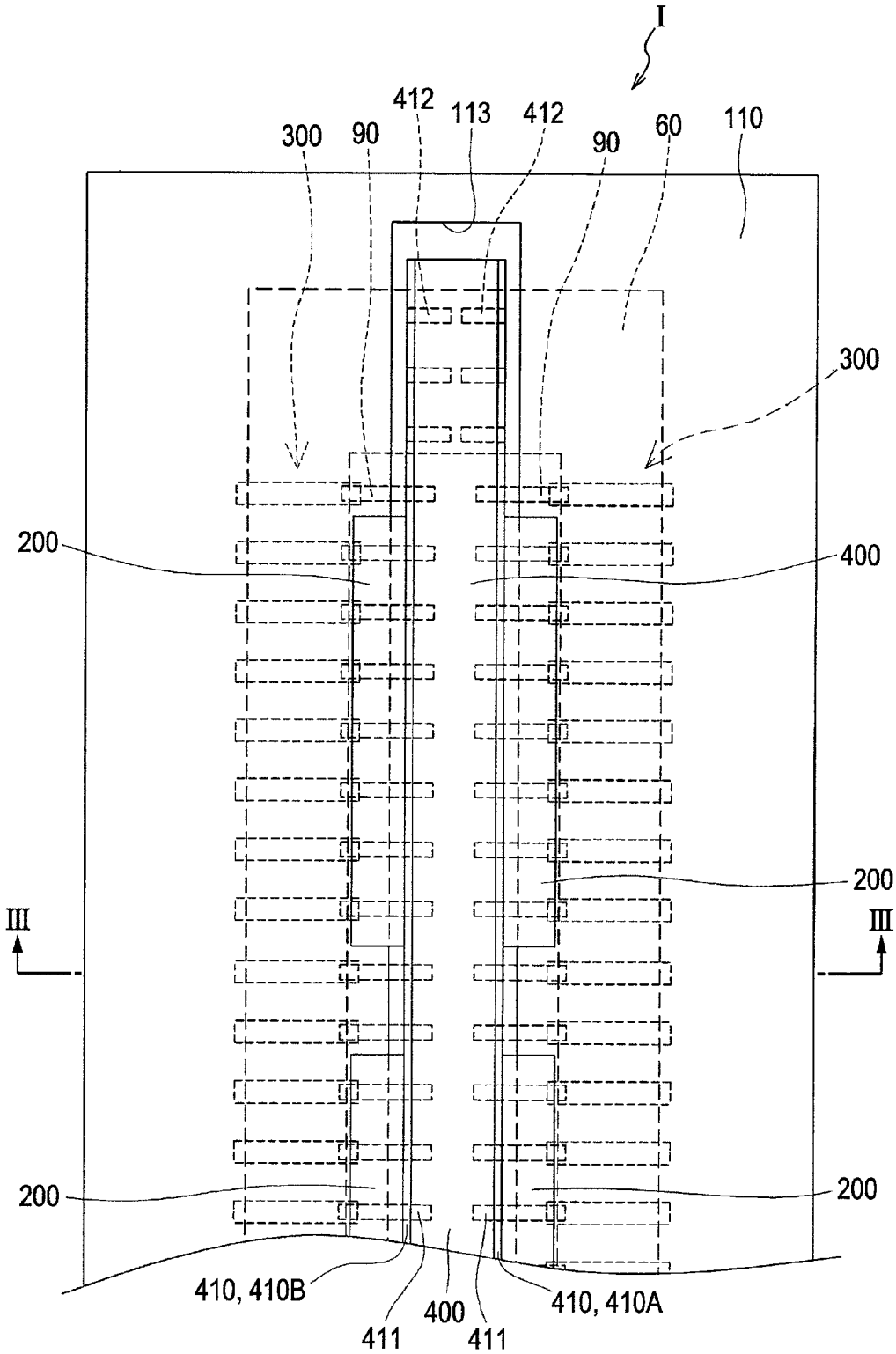
FIG. 2 is a plan view of the recording head according to the embodiment of the invention.
Figure 3:
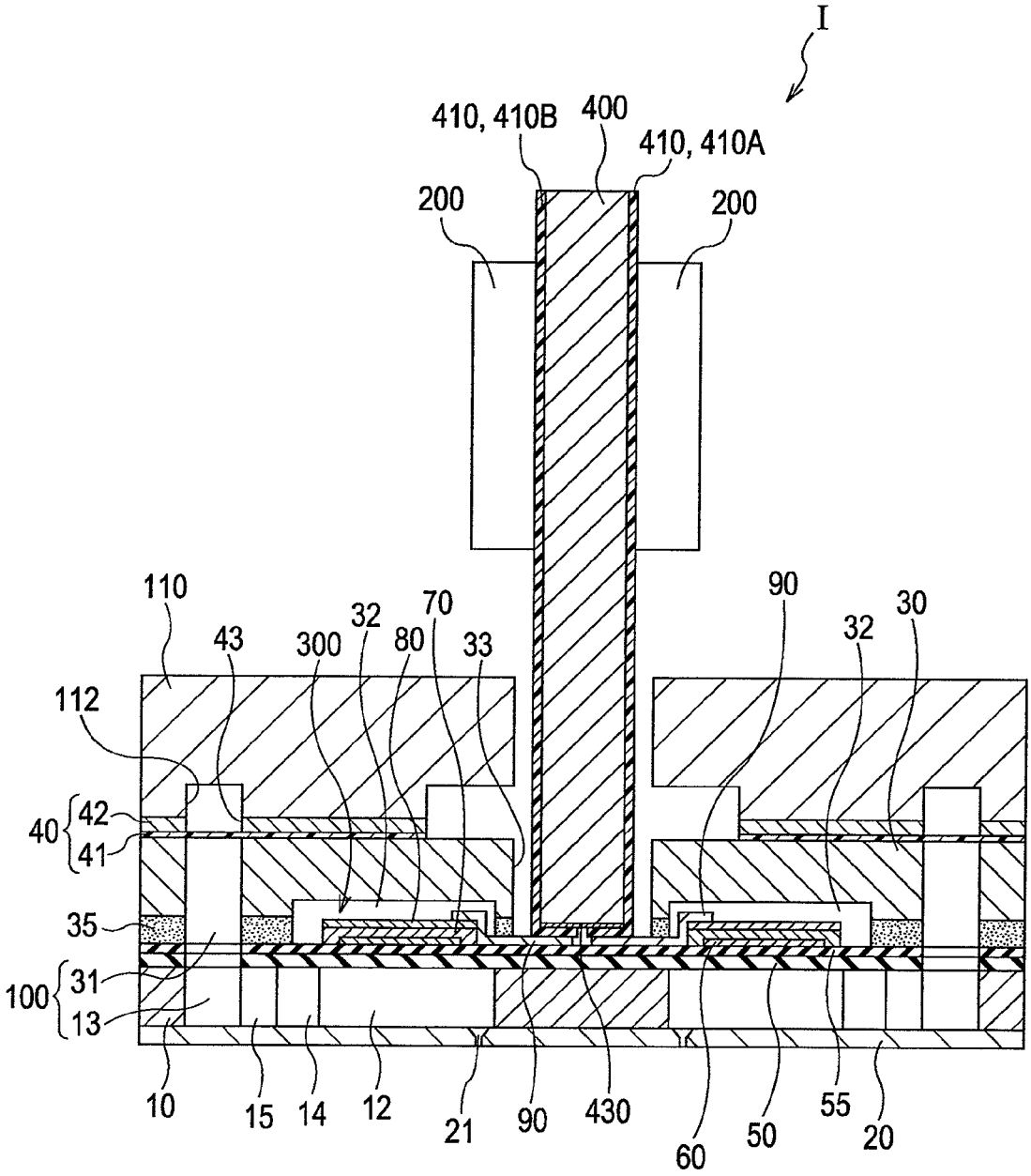
FIG. 3 is a cross-sectional view of the recording head according to the embodiment of the invention.

FIG. 1 is an exploded perspective view illustrating a schematic configuration of an ink jet recording head as an example of a liquid ejecting head according to an embodiment of the invention. FIG. 2 is a plan view of the ink jet recording head illustrated in FIG. 1, and FIG. 3 is a cross-sectional view taken along the lines III-III in FIG. 2.

As illustrated in the drawings, a flow path forming substrate 10 is formed of a single crystal silicon substrate which has a plane (110) of the plane orientation in the present embodiment. An elastic film 50 which is preliminarily formed of silicon dioxide is formed on one surface of the flow path forming substrate 10.

In the flow path forming substrate 10, two rows of a plurality of pressure generating chambers 12 which are partitioned by partition walls 11 are arranged in the width direction of the flow path forming substrate 10. A communicating portion 13 is formed in an outer region in the longitudinal direction of the pressure generating chambers 12 of each row, and the communicating portion 13 and each of the pressure generating chambers 12 are communicated with each other via an ink supply path 14 and a communicating path 15 which are provided for each of the pressure generating chambers 12. The communicating portion 13 is communicated with a reservoir portion 31 of a later-described protective substrate 30, thereby constituting a portion of a reservoir 100 which serves as a common ink chamber for each row of the pressure generating chambers 12. The ink supply path 14 is formed with a width narrower than that of the pressure generating chambers 12, and is configured to keep constant resistance of the flow path of ink flowing from the communicating portion 13 into the pressure generating chambers 12. In the present embodiment, although the ink supply path 14 is formed by narrowing the width on one side of the flow path, the ink supply path 14 may be formed by narrowing the width on both sides of the flow path. Moreover, the ink supply path 14 may be formed by narrowing the size in a thickness direction thereof, rather than narrowing the width. Each of the communicating paths 15 is formed by extending the partition walls 11 on both sides in the width direction of each of the pressure generating chambers 12 to the communicating portion 13, thereby partitioning a space between the ink supply path 14 and the communicating portion 13. That is to say, on the flow path forming substrate 10, the ink supply paths 14 each having a smaller sectional size than a sectional size in the width direction of each of the pressure generating chambers 12 and the communicating paths 15 each having a larger sectional size than the sectional size in the width direction of each of the ink supply paths 14 and being communicated with the ink supply paths 14 are formed to be partitioned by a plurality of partition walls 11.

On an opening-side surface of the flow path forming substrate 10 where an opening is formed, a nozzle plate 20 having nozzle openings 21 bored therein which are communicated with a zone near the end portions of the pressure generating chambers 12 on the side opposite to the liquid supply paths 14 is fixedly secured by an adhesive or a heat welding film. In the present embodiment, since two rows of pressure generating chambers 12 are arranged on the flow path forming substrate 10, two nozzle arrays of the nozzle openings 21 are arranged in one ink jet recording head I. The nozzle plate 20 is formed of a glass ceramic, a single crystal silicon substrate, or stainless steel, for example.

On the surface of the flow path fowling substrate 10 opposite to the opening-side surface, the elastic film 50 is formed, as described above, and an insulating film 55 is formed on the elastic film 50. On the insulating film 55, a lower electrode film 60, a piezoelectric layer 70, and an upper electrode film 80 are formed in a laminated state, thereby constituting a piezoelectric element 300, which is a pressure generating element according to the present embodiment. The piezoelectric element 300 refers to a portion including the lower electrode film 60, the piezoelectric layer 70, and the upper electrode film 80. Generally, one of the electrodes of the piezoelectric element 300 is used as a common electrode, and the other electrode and the piezoelectric layer 70 are patterned to be constructed for each of the pressure generating chambers 12. A portion, which is composed of any one of the electrodes and the piezoelectric layer 70 that have been patterned, and which undergoes piezoelectric distortion upon application of voltage to both electrodes, is called a piezoelectric active portion. In the present embodiment, the lower electrode film 60 is used as the common electrodes for the piezoelectric elements 300, while the upper electrode film 80 is used as an individual electrode of each of the piezoelectric elements 300. However, there is no harm in reversing their usages for the convenience of the driving circuit or wiring. Here, the piezoelectric elements 300 and a vibration plate, where displacement occurs by the driving of the piezoelectric elements 300, are collectively referred to as a piezoelectric actuator. Although in the described example, the elastic film 50, the insulating film 55, and the lower electrode film 60 are functioning as the vibration plate, the invention is not particularly limited to this. For example, the elastic film 50 and the insulating film 55 may not be provided, and only the lower electrode film 60 may function as the vibration plate. Moreover, the piezoelectric elements 300 may substantially function as the vibration plate.

The piezoelectric layer 70 is formed of a piezoelectric material which is formed on the lower electrode 60 and exhibits electromechanical conversion action, and among the piezoelectric materials, a ferroelectric material having the Perovskite structure. It may be preferable that the piezoelectric layer 70 is formed of a crystallization film having the Perovskite structure. For example, the ferroelectric material such as lead zirconate titanate (PZT) or a material formed by adding metal oxide such as niobium oxide, nickel oxide, or magnesium oxide to lead zirconate titanate is suitable for the material of the piezoelectric layer. Specifically, lead titanate ($PbTiO_3$), lead zirconate titanate ($Pb(Zr, Ti)O_3$), lead zirconate acid ($PbZrO_3$), lead lanthanum titanate ($(Pb, La), TiO_3$), lead lanthanum zirconate titanate ($(Pb, La)(Zr, Ti)O_3$), lead magnesium niobate zirconate titanate ($Pb(Zr, Ti)(Mg, Nb)O_3$), or the like can be used. As for the thickness of the piezoelectric layer 70, the piezoelectric layer 70 is formed to a thickness capable of preventing occurrence of cracks during the manufacturing process thereof and exhibiting sufficient displacement characteristics.

In FIGS. 2 and 3, a lead electrode 90 which is provided to be extended to the insulating film 55 and formed of gold (Au), for example, is connected to the upper electrode film 80 which is the individual electrodes of the piezoelectric elements 300. The lead electrode 90 has one end thereof being connected to the upper electrode film 80 and the other end thereof being extended between the rows of the piezoelectric elements 300.

On the flow path forming substrate 10 where the piezoelectric elements 300 are formed, that is, on the lower electrode 60, the elastic film 50, and the lead electrode 90, a protective substrate 30 having a reservoir portion 31 which constitutes at least a portion of the reservoir 100 is bonded via an adhesive 35. In the present embodiment, the reservoir portion 31 is provided along the width direction of the pressure generating chambers 12 so as to penetrate through the protective substrate 30 in a thickness direction thereof. The reservoir portion 31 is communicated with the communicating portion 13 of the flow path forming substrate 10, thereby constituting the reservoir 100 which serves as a common ink chamber for the respective pressure generating chambers 12. Although in the present embodiment, the communicating portion 13 serving as the reservoir 100 is provided in the flow path forming substrate 10, the invention is not particularly limited to this. For example, the communicating portion 13 of the flow path forming substrate 10 may be divided into a plurality of parts which correspond to the pressure generating chambers 12, so that the reservoir is constituted only by the reservoir portion 31. Moreover, only the pressure generating chambers 12 may be provided in the flow path forming substrate 10, and the ink supply path 14 may be provided to the member (for example, the elastic film 50, the insulating film 55, and the like) disposed between the flow path forming substrate 10 and the protective substrate 30 so as to be communicated with the reservoir 100 and the pressure generating chambers 12.

The protective substrate 30 has a piezoelectric element holding portion 32 which is defined in a region of the protective substrate 30 opposed to the piezoelectric element 300 and has such a space that the movement of the piezoelectric element 300 is not inhibited. As long as the space of the piezoelectric element holding portion 32 does not inhibit the movement of the piezoelectric element 300, the space may be, or may not be, hermetically sealed. In the present embodiment, since the piezoelectric elements 300 are arranged in two rows, the piezoelectric element holding portions 32 are provided so as to correspond to the rows of the piezoelectric elements 300. That is to say, two piezoelectric element holding portions 32 are provided on the protective substrate 30 to be arranged in the arrangement direction of the rows of the piezoelectric elements 300.

The protective substrate 30 having such a configuration is preferably formed of a material having approximately the same thermal expansion coefficient as that of the flow path forming substrate 10, and examples of such a material include glass, a ceramic material, or the like. In the present embodiment, the protective substrate 30 is formed using a single crystal silicon substrate which is formed of the same material as that of the flow path forming substrate 10.

In the protective substrate 30, a through-hole 33 is bored so as to penetrate through the protective substrate 30 in the thickness direction thereof. In the present embodiment, the through-hole 33 is provided between the two piezoelectric element holding portions 32. The lead electrodes 90 which are led out from the respective piezoelectric elements 300 have the extreme ends thereof being exposed to the inside of the through-hole 33.

Driving circuits 200 for driving the piezo-electric elements 300 are mounted on COF substrates 410, which are flexible printed boards. Here, the COF substrates 410 are erected substantially in the vertical direction with lower ends thereof being connected to the lead electrodes 90 and are fixed to the side surfaces of a plate-like member 400. In the present embodiment, the plate-like member 400 is a rectangular parallelepiped member having vertical side surfaces, and the plate-like member 400 functions as a support member that supports the COF substrates 410.

Specifically, in the ink jet recording head I according to the present embodiment, since two rows of pressure generating chambers 12 are provided in the flow path forming substrate 10, two rows of piezoelectric elements 300 are provided in the width direction (the width direction of the piezoelectric elements 300) of the pressure generating chambers 12. That is to say, two rows of the pressure generating chambers 12, piezoelectric elements 300, and lead electrodes 90 are arranged so as to oppose each other. In addition, the COF substrates 410 are respectively fixed to both side surfaces of the plate-like member 400 having a lower part thereof being inserted into the through hole 33, and each of the COF substrates 410 is erected substantially in the vertical direction with the lower end thereof being connected to the end portion of each of the lead electrodes 90 of each row of the piezoelectric elements 300. In the present embodiment, by providing one COF substrate 410 to each of the side surfaces of the plate-like member 400, a total of two COF substrates 410 are provided to one plate-like member 400.

Since the COF substrates 410 which are flexible printed boards are likely to bend when they are caused to be erected singly, by attaching the COF substrates 410 to the plate-like member 400 which is a rigid member serving as a support, it is possible to erect the COF substrates 410 while preventing bending thereof. In the present embodiment, the COF substrates 410A and 410B which are provided on both side surfaces of the plate-like member 400 have the entire rear surfaces thereof which are attached to the plate-like member 400 by an adhesive. The adhesive for attaching the COF substrates 410A and 410B to the plate-like member 400 may preferably be an adhesive having a relatively short curing time such as a UV-curable adhesive or an instant adhesive.

As illustrated in FIG. 3, a buffer member 430 that is preferably made of Teflon (the registered trademark) is provided between a lower end surface of the plate-like member 400 and a lower end portion of each of the COF substrates 410 (COF substrates 410A and 410B). The lower end portions of the COF substrates 410 and the lead electrodes 90 are electrically connected to each other by an anisotropic conductive adhesive which is an example of an anisotropic conductive material. That is to say, when the plate-like member 400 is pressed, the lower end surface thereof presses the COF substrates 410 against the lead electrodes 90. In this way, conductive particles contained in the anisotropic conductive adhesive are collapsed so that a desired electrical connection is achieved between the COF substrates 410 and the lead electrodes 90. In this case, the buffer member 430 functions to apply a uniform pressing force to the COF substrates 410. Here, It may be preferable that the lower end surface of the plate-like member 400 and the lower end portions of the COF substrates 410, or the lower end surface of the plate-like member 400 making abutting contact with the buffer member 430, have a profile irregularity that is less than five times the diameter of the conductive particles. By doing so, it is possible to apply a uniform pressing force to the conductive particles via the lower end portions of the COF substrates 410 due to the presence of the buffer member 430. As a result, it is possible to collapse the conductive particles with certainty to ensure reliable electrical connection.

It may be preferable that the plate-like member 400 be formed of a material having a thermal conductivity capable of reducing the temperature of the driving circuit to be lower than a junction temperature even when the ink jet recording head I is operating at a maximum operation temperature at which the ink jet recording head I is guaranteed to operate. In this case, a sufficient dissipation effect is obtained even when the driving circuit is operated under the most severe load conditions. As a result, it is possible to operate stably the driving circuit for a long time. For this reason, in the present embodiment, the plate-like member 400 is formed of an SUS material. In this case, ink flowing through the flow path forming substrate 10 can absorb heat generated from the driving circuits 200 through the plate-like member 400. As a result, it is possible to dissipate effectively heat generated from the driving circuits 200. The above-mentioned operation and effect can be obtained by sufficiently reducing the distance between the surface of the flow path forming substrate 10 and the driving circuits 200, even when a metal material, such as SUS, is not used. That is to say, It may be preferable that the distance between the driving circuits 200 and the surface of the flow path forming substrate 10 is set to a value so that the temperature of the driving circuits 200 is lower than its junction temperature even when the liquid ejecting head I is used at the maximum operation temperature.

It may be preferable that the plate-like member 400 is formed of a material having the same linear expansion coefficient as a later-described head casing 110 which is a holding member, and examples of such material include stainless steel and silicon.

As illustrated in FIG. 3, a compliance plate 40, which includes a sealing film 41 and a fixing plate 42, is bonded onto the protective substrate 30. The sealing film 41 is formed of a flexible material having a low rigidity (for example, a polyphenylene sulfide (PPS) film), and the sealing film 41 seals one surface of the reservoir portion 31. The fixing plate 42 is formed of a hard material such as a metal (for example, stainless steel (SUS)). A region of the fixing plate 42 opposing the reservoir 100 defines an opening portion 43 which is completely removed in the thickness direction thereof. Thus, one surface of the reservoir 100 is sealed only by the sealing film 41 having flexibility. Moreover, the head casing 110 which is the holding member is provided on the compliance substrate 40. An ink introduction path 111 is formed in the head casing 110 so as to be communicated with an ink introduction port 44 to supply ink from an ink storage unit such as a cartridge to the reservoir 100. Moreover, a concave portion 112 is formed in a region of the head casing 110 opposing the opening portion 43 so that the bending of the opening portion 43 is appropriately achieved. Furthermore, a wire member holding hole is formed in the head casing 110 so as to be communicated with the through-hole formed in the protective substrate 30 so that the wire member is inserted through the wire member holding hole to be connected to the lead electrodes 90. The wire member inserted through the wire member holding hole of the head casing 110 is attached to the head casing 110 by an adhesive.

The head casing 110 may be formed of a metal material such as stainless steel.

Figure 4:
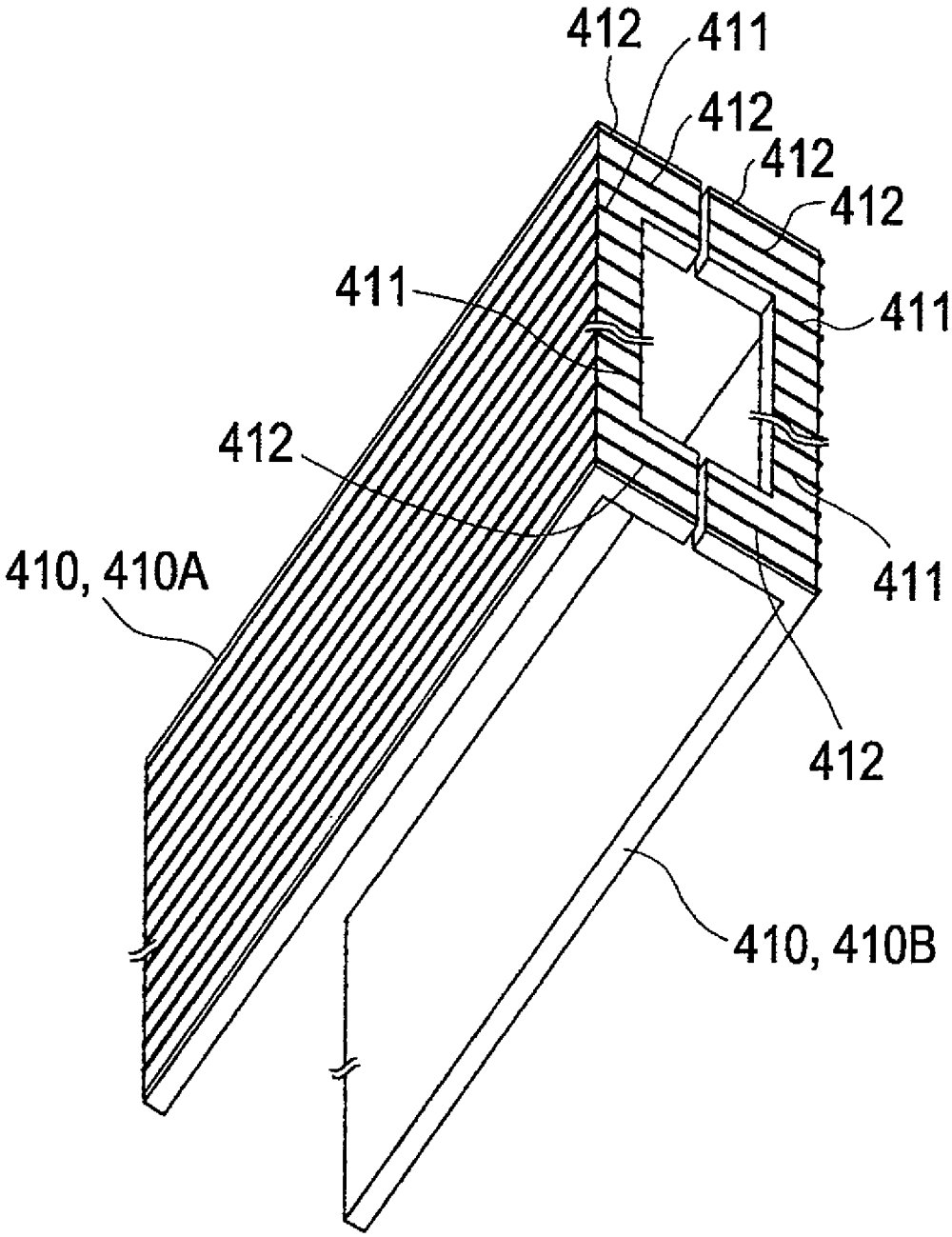
FIG. 4 is a perspective enlarged view, in part cross-sectioned, illustrating a COF substrate in FIG. 3.

FIG. 4 is a perspective enlarged view, in part cross-sectioned, illustrating the COF substrate in FIG. 3. As illustrated in the drawing, the COF substrates 410A and 410B respectively have individual wires 411 and common wires 412. The individual wires 411 are arranged at positions corresponding to the lead electrodes 90 (see FIG. 2) which are electrically connected to the individual electrodes of the piezoelectric elements 300, and are connected to the lead electrodes 90. The common wires 412 are arranged on both ends in the row direction of the COF substrates 410A and 410B, and are arranged at positions corresponding to the lead electrodes 90 which are electrically connected to the lower electrode film 60 (see FIG. 2), which is the common electrodes of the piezoelectric elements 300 (see FIG. 2), the common wires 412 being connected to the lower electrode film 60. Although the COF substrates 410A and 410B are mounted on both side surfaces of the plate-like member 400, an end of the COF substrate 410A which is close to the COF substrate 410B and corresponds to the individual wires 411 is partially cut out, and an end of the COF substrate 410B which is close to the COF substrate 410A and corresponds to the individual wires 411 is partially cut out. In this way, the COF substrates 410A and 410B are formed such that a spacing between the common wires 412 of the COF substrate 410A and the common wires 412 of the COF substrate 410B is narrower than a spacing between the individual wires 411 of the COF substrate 410A and the individual wires 411 of the COF substrate 410B.

Next, a method for manufacturing the ink jet recording head according to the present embodiment, particularly a fixing method which accompanies alignment of the COF substrates 410A and 410B with respect to the plate-like member 400 will be described with reference to FIGS. 5A and 5B. The drawings are perspective views, in part cross-sectioned, illustrating the method for manufacturing the ink jet recording head.

Figure 5A:
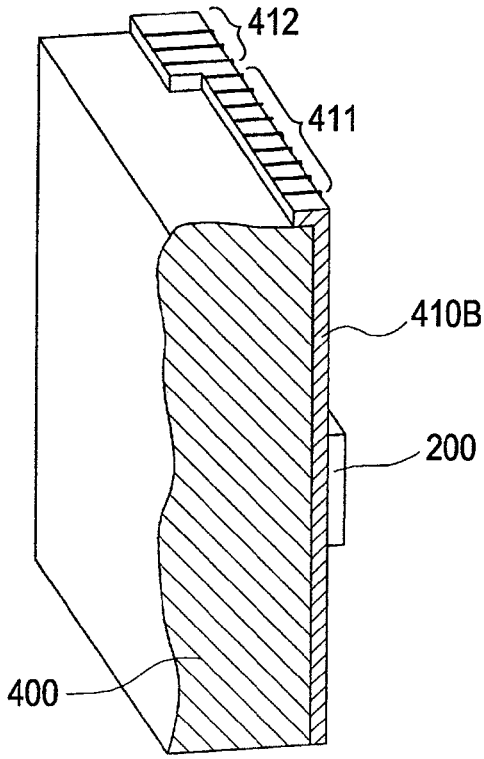
FIGS. 5A and 5B are perspective views, in part cross-sectioned, illustrating a method for manufacturing the recording head according to the embodiment of the invention.

First, as illustrated in FIG. 5A, the COF substrate 410B having a partially cut-out end thereof which corresponds to the individual wires 411 is attached to one side surface of the plate-like member 400. The method of attaching the plate-like member 400 and the COF substrate 410B is not particularly limited, and in the present embodiment, the entire rear surface of the COF substrate 410B is attached to the plate-like member 400 by an adhesive.

Figure 5B:
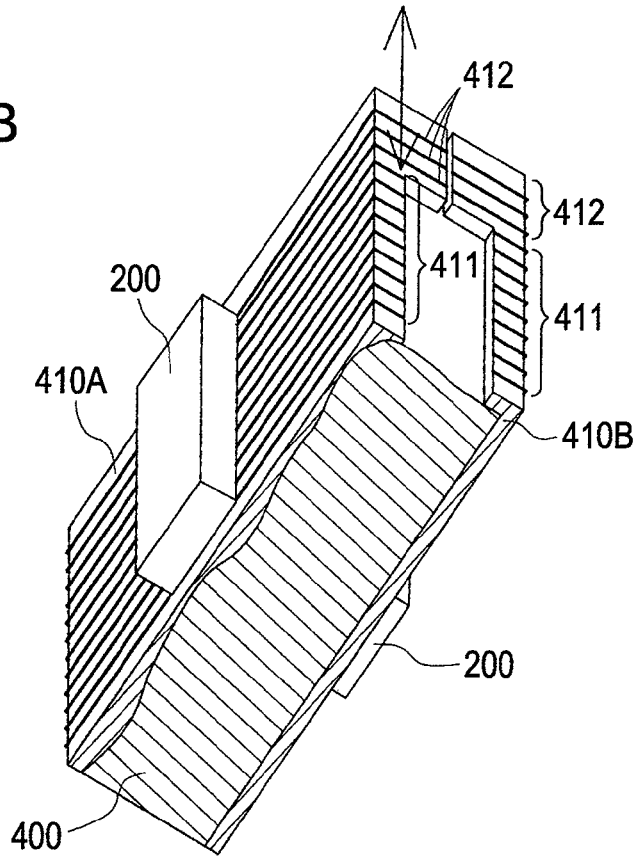

Next, as illustrated in FIG. 5B, the COF substrate 410A is mounted on the other side surface of the plate-like member 400 opposite to the side surface thereof attached to the COF substrate 410B. At this time, the COF substrate 410A mounted on the plate-like member 400 is held on the plate-like member 400 by its own weight or pressing. Moreover, the COF substrate 410B provided on the other surface of the plate-like member 400 will not fall down because it is attached to the plate-like member 400.

Here, the used COF substrate 410A has a partially cut-out end which corresponds to the individual wires 411 and has a bent lower end portion which is connected to the lead electrodes 90. This is because, when the lower end portion of the COF substrate 410A is bent along the plate-like member 400 after the COF substrate 410A is attached to the plate-like member 400, it is difficult to achieve positioning of the COF substrates 410A and 410B, and moreover, there is a concern that the COF substrate 410A is misaligned because of the bending.

In such a state, first, the COF substrate 410A is moved in the arrangement direction (the direction indicated by the arrows in the drawing) of the lead electrodes 90 with respect to the COF substrate 410B attached to the plate-like member 400, thereby positioning the COF substrate 410A relative to the COF substrate 410B. In this way, the positioning of the individual wires 411 connected to the lead electrodes 90 of the COF substrate 410B, which is preliminarily attached to the plate-like member 400, and the individual wires 411 connected to the lead electrodes 90 of the other COF substrate 410A can be achieved in the arrangement directions thereof. More specifically, although not illustrated, an image of the portion corresponding to the common wires 412 is captured through a camera from a direction (from the upper-right direction in the drawing) opposing the lower end portion of the COF substrate 410A connected to the lead electrodes 90. Then, the image is analyzed to identify the positions of the common wires 412, whereby the position of the COF substrate 410A is automatically adjusted to be aligned to a predetermined position. At this time, since the extreme ends of the common wires 412 of the COF substrates 410A and 410B are formed at a closer distance than the extreme ends of the individual wires 411, it is possible to obtain sufficient image information necessary for the alignment even when the capturing area of the camera is narrowed down to the extreme ends of the common wires 412. Therefore, the magnification of the camera can be increased more, and thus highly accurate alignment can be achieved. On the other hand, since the extreme ends of the individual wires 411 of the COF substrates 410A and 410B are at a sufficiently far distance, there is no concern that they are short-circuited. In addition, since the common wires 412 are electrically connected to the lower electrode film 60 (see FIG. 2) which is the common electrodes of the piezoelectric elements 300 (see FIG. 2), it does not matter if short-circuits occur.

In this manner, after the position of the COF substrate 410B is adjusted, the COF substrate 410A is attached to the plate-like member 400 while preventing misalignment thereof. Thereafter, the individual wires 411 and the common wires 412 with an anisotropic conductive material interposed therebetween are fixed to be connected to the lead electrodes 90. In this way, an ink jet recording head is manufactured, and an ink jet recording apparatus can be manufactured by incorporating the manufactured ink jet recording head.

In the described ink jet recording head, ink is drawn from an ink introduction port connected to an external ink storage unit (not illustrated), and the interior of the head ranging from the reservoir 100 to the nozzle openings 21 is filled with ink. Then, according to recording signals from the driving circuits 200, a voltage is applied between the lower electrode film 60 and the upper electrode film 80 corresponding to each of the pressure generating chambers 12, whereby the elastic film 50, the insulating film 55, the lower electrode film 60, and the piezoelectric layer 70 are caused to warp and deform. As a result, the internal pressure of the pressure generating chambers 12 is increased, and thus ink is ejected through the nozzle openings 21.

According to the present embodiment, since the driving circuits 200 and the lead electrodes 90 of the piezoelectric elements 300 are connected via the COF substrates 410 having the driving circuits 200 mounted thereon, it is possible to facilitate the manufacture thereof rather than the known method that uses a wire bonding method. Moreover, since the COF substrates 410 are erected substantially in the vertical direction with lower ends thereof being connected to the lead electrodes 90, it is possible to achieve a reduction in the size of the ink jet recording head. Furthermore, since the COF substrates 410 are directly connected to the lead electrodes 90, even when the piezoelectric elements 300 are arranged in high density, it is possible to achieve easily a high-density mounting without any connection failure between the lead electrodes 90 and the COF substrates 410. Furthermore, since the driving circuits 200 are attached to the side surfaces of the plate-like member 400 via the COF substrates 410, it is possible to dissipate effectively heat generated from the driving circuits 200.

Other Embodiment

While the exemplary embodiment of the invention has been described, the structure of the invention is not limited to the described structure. In the above-described embodiment, the plate-like member 400 or the like is pressed to collapse the conductive particles, other members may be pressed to collapse the conductive particles without using the support member, and then the support member may be fixed to the wiring boards after the pressing. Moreover, in the above-described embodiment, although the driving circuits 200 are mounted via the plate-like member 400, in order to achieve high-density mounting without performing connection using a wire bonding method, the individual wires 411 of the wiring boards may be directly connected to the lead electrodes 90. In this case, the spacing between the common wires 412 is formed to be narrower than the spacing between the individual wires 411 of the opposing two rows.

The support member is not particularly limited to the plate shape but may be formed in any shape, so long as it can exhibit a predetermined supporting function. For example, the support member may have a lattice shape or a raft shape. However, when the support member is pressed to collapse the conductive particles, it may be preferable that the lower end surface of the support member be flat in order to apply a uniform pressing force.

In the above-described embodiment, although two rows of pressure generating chambers 12 are provided in the flow path forming substrate 10, the number of rows of pressure generating chambers is not limited to this configuration. Moreover, in the above-described embodiment, although an actuator device which includes the thin-film piezoelectric elements 300 was described as an example of the pressure generating element that causes a pressure change in the pressure generation chamber 12, the invention is not particularly limited to this. For example, a thick-film actuator device, which is formed by attaching a green sheet thereto, and a longitudinal-vibration actuator device, which is formed by laminating a piezoelectric material and an electrode forming material in an alternating order may be used as the pressure generating element. Moreover, an actuator device in which a heating element is provided in the pressure generation chamber so that liquid droplets are ejected from the nozzle openings by utilizing bubbles formed as a result of heat generated by the heating element may be used as the pressure generating element. Furthermore, a so-called electrostatic actuator device in which static electricity is generated between a vibration plate and electrodes, the electrostatic force causing the vibration plate to deform, whereby liquid droplets are ejected from the nozzle openings may be used as the pressure generating element.

Furthermore, in the above-described embodiment, the ink jet recording head is taken for illustration as an example of the liquid ejecting head. However, the invention is aimed to cover broadly the overall liquid ejecting head and, needless to say, can be applied to liquid ejecting heads for ejecting liquid other than ink. Examples of other liquid ejecting heads include a recording head for use in an image recording apparatus such as a printer, a coloring-material jet head for use in manufacture of a color filter of a liquid crystal display or the like, an electrode-material jet head for use in forming an electrode of an organic EL display, an FED (field emission display) or the like, a bioorganic-material jet head for use in manufacture of a biochip, and the like.

Figure 6:
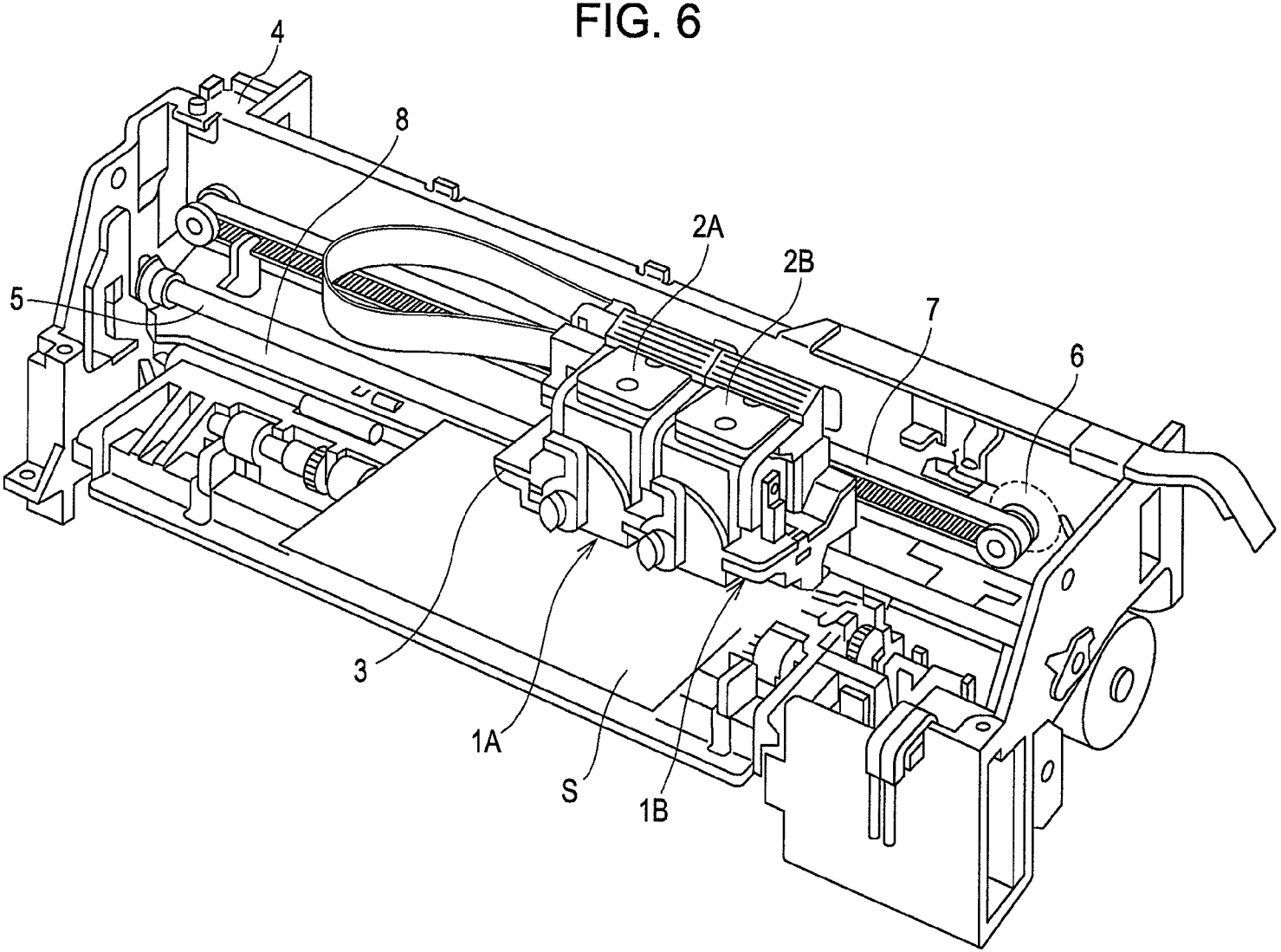
FIG. 6 is a schematic perspective view illustrating an ink jet recording apparatus according to the embodiment of the invention.

The ink jet recording head according to the above-described embodiment constitutes a portion of a recording head unit which is provided with an ink flow path configured to communicate with an ink cartridge or the like and is mounted on a liquid ejecting apparatus. FIG. 6 is a schematic view illustrating an example of the ink jet recording apparatus. As illustrated in the drawing, recording head units 1A and 1B, which have ink jet recording heads I according to the above-described embodiment, respectively, are provided so as to be respectively detachably attached to cartridges 2A and 2B which form an ink supply unit, and a carriage 3 mounting thereon the recording head units 1A and 1B is axially movably provided to a carriage shaft 5 which is attached to an apparatus body 4. The recording head units 1A and 1B are configured to eject, for example, black ink composition and color ink composition, respectively.

When a driving force of a driving motor 6 is transferred to the carriage 3 via a plurality of gears (not illustrated) and a timing belt 7, the carriage 3 mounting thereon the recording head units 1A and 1B is moved along the carriage shaft 5. On the other hand, a platen 8 is provided to the apparatus body 4 along the carriage shaft 5 so that a recording sheet S which is a recording medium such as paper fed by a feed roller (not illustrated) or the like is transported in a state of being wound around the platen 8. The invention can be applied to liquid ejecting heads for ejecting liquid other than ink.

What is claimed is:

1. A liquid ejecting head which ejects liquid from nozzle openings by driving pressure generating elements, comprising:

at least two rows of lead electrodes that supply an electrical signal to the pressure generating elements; and at least two wiring boards for supplying the electrical signal to the lead electrodes, wherein:

the wiring boards respectively have individual wires which are electrically connected to the pressure generating elements, respectively, via the lead electrodes, and common wires which are electrically connected in common to a plurality of pressure generating elements via the lead electrodes; and, the wiring boards are formed such that a spacing between the respective common wires of the two opposing wiring boards is narrower than a spacing between the respective individual wires of the two opposing wiring boards.

2. The liquid ejecting head according to claim 1, wherein the respective wiring boards are formed to be erected from a surface having the lead electrodes provided thereon.

3. The liquid ejecting head according to claim 2, wherein the respective wiring boards are supported by a support member that supports the wiring boards to be erected from the surface having the lead electrodes provided thereon.

4. The liquid ejecting head according to claim 3, wherein a driving circuit that applies a driving voltage to the pressure generating elements is mounted on each of the wiring boards at a region facing the support member.

5. The liquid ejecting head according to claim 1, wherein a connection of the wiring boards to the lead electrodes is achieved via an anisotropic conductive material.

6. A liquid ejecting apparatus comprising the liquid ejecting head according to claim 1.

7. A method for manufacturing a liquid ejecting head which ejects liquid from nozzle openings by driving pressure generating elements and comprises:

at least two rows of lead electrodes that supply an electrical signal to the pressure generating elements; and first and second wiring boards respectively having individual wires which are electrically connected to the pressure generating elements, respectively, via the lead electrodes, and common wires which are electrically connected in common to a plurality of pressure generating elements via the lead electrodes, the method comprising the steps of:

arranging the first and second wiring boards so as to oppose each other such that a spacing between the common wires of the first wiring board and the common wires of the second wiring board is narrower than a spacing between the individual wires of the first wiring board and the individual wires of the second wiring board;

adjusting a relative position of the first wiring board and the second wiring board using the common wires after the first and second wiring boards are arranged so as to oppose each other; and connecting the first and second wiring boards having adjusted their relative position to the respective lead electrodes.

8. The method for manufacturing the liquid ejecting head according to claim 7, wherein the adjusting step adjusts the positions of the common electrodes of the second wiring board to be aligned with the positions of the common electrodes of the first wiring board in a state where the first wiring board is supported on one surface of a support member, whereby the second wiring board is supported on the other surface of the support member.

* * * * *